US005886447A

United States Patent [19]

Hatsios et al.

[11] Patent Number: 5,886,447

[45] Date of Patent: Mar. 23, 1999

[54] SLIP RING DESIGN FOR A ROTOR OF AN ELECTRICAL MACHINE

[75] Inventors: Michael John Hatsios, Plymouth; Richard Kenneth Harris, Walled Lake; Michael Timothy York, Chelsea, all of Mich.

[73] Assignee: Ford Motor Company, Dearborn, Mich.

[21] Appl. No.: 960,892

[22] Filed: Oct. 30, 1997

[51] Int. Cl.[6] ..... H01R 39/08

[52] U.S. Cl. ..... 310/232

[58] Field of Search ..... 310/232, 42, 263

[56] References Cited

U.S. PATENT DOCUMENTS

| | | | |
|---|---|---|---|
| 728,614 | 5/1903 | Priest | 310/232 |
| 1,460,031 | 6/1923 | Meyercordt | 310/232 |
| 1,580,530 | 4/1926 | Rambo | 310/232 |
| 1,870,236 | 8/1932 | Chervenka | 310/232 |
| 3,252,025 | 5/1966 | Brown et al. | 310/168 |
| 3,305,740 | 2/1967 | Shano | 310/42 |
| 4,105,907 | 8/1978 | Hagenlocher et al. | 310/232 |
| 4,406,961 | 9/1983 | Pfluger et al. | 310/232 |
| 4,584,496 | 4/1986 | Frister | 310/60 R |
| 4,645,962 | 2/1987 | Freeman | 310/232 |
| 5,130,595 | 7/1992 | Arora | 310/268 |
| 5,214,335 | 5/1993 | Phillips et al. | 310/232 |
| 5,329,199 | 7/1994 | Yockey et al. | 310/263 |
| 5,551,143 | 9/1996 | Saval et al. | 310/263 |

FOREIGN PATENT DOCUMENTS

| | | | |
|---|---|---|---|
| 3136500 | 6/1982 | Germany | 310/232 |
| 1333165 | 10/1973 | United Kingdom | 310/232 |

*Primary Examiner*—Clayton LaBalle
*Attorney, Agent, or Firm*—Mark S. Sparschu

[57] ABSTRACT

A rotor for an electrical machine according to one embodiment of the present invention includes first and second individual slip rings mounted on a rotor shaft. A first end of the coil wire for the rotor passes through a first axial passage in the first slip ring and is terminated to conductive material on an axial end of that slip ring. The other end of the coil wire passes through a second axial passage in the first slip ring and through an axial passage in the second slip ring and is terminated to conductive material on an axial end of the second slip ring. The second axial passage of the first slip ring is electrically insulated from the conductive material of that slip ring, so the second wire end does not inadvertently short-circuit to the first conductive material. Also, the first and second slip rings are each designed to cooperate in providing a gap therebetween which provides space to accommodate the termination of the first wire end onto the axial end of the first slip ring.

12 Claims, 3 Drawing Sheets

SLIP RING DESIGN FOR A ROTOR OF AN ELECTRICAL MACHINE

BACKGROUND OF THE INVENTION

1. Field of the Invention

The present invention relates generally to rotors for electrical machines and more particularly to an improved design for the construction of slip rings for such machines and termination of electrical connections to the slip rings.

2. Description of the Related Art

In many electrical machines, a rotor includes an electromagnetic field generating coil which rotates with the rotor. In such machines, slip rings are typically provided as a part of the rotor assembly. The slip rings are means for connecting the field-generating coil to a source of electrical current.

Typical slip ring designs can present reliability improvement opportunities. For example, the two slip rings in a rotor are typically manufactured as a single assembly, with two wires extending from the assembly for connection to the field-generating coil. A first end of each wire is welded to a respective slip ring. A second end of each wire is welded to the wire which comprises the windings of the field-generating coil. The result is four interconnections between the field-generating coil and the slip rings. Although such designs have been honed to a relatively high degree of reliability, a reduction in the number of interconnections can improve reliability further. Also, the connections between the wires and the slip rings are challenging connections which, although reliable, can be made more reliable.

An additional area of potential improvement in prior art designs is in the cost of the slip ring assembly. A typical slip ring assembly is manufactured by the aforementioned welding of wires to the slip rings, followed by insert-molding of this subassembly in plastic. The resulting slip ring assembly is a fairly expensive part, exhibiting considerable opportunity for cost reduction.

Therefore, slip ring designs for electrical machine rotors which can provide improved reliability and reduced cost can provide advantages over the prior art.

SUMMARY OF THE INVENTION

The present invention also provides a second rotor for an electrical machine. The rotor comprises a shaft defining an axis of rotation of the rotor and a field-generating coil mounted for rotation with the shaft, the coil comprising wire with a first wire end and a second wire end. The rotor also includes a first slip ring mounted for rotation with the shaft and defining a first circumferential periphery and a first axial end, and comprising first conductive material disposed about the first circumferential periphery and second conductive material disposed on the first axial end, the first conductive material in electrical communication with the second conductive material, the first axial end further having a first portion with respect to which the first conductive material is axially recessed. In addition, the rotor comprises a second slip ring mounted for rotation with the shaft and defining a second circumferential periphery and a second axial end, and comprising third conductive material disposed about the second circumferential periphery, the second axial end further having a second and third portion, the second portion axially recessed with respect to the third portion. The second slip ring is mounted adjacent the first slip ring, with the first axial end and the second axial end adjacent one another and the first conductive material and the second portion aligned to form a gap therebetween. Further, the first wire end is electrically and physically coupled to the first conductive material.

Rotor designs according to the present invention provide the opportunity for reliability improvement and cost reduction. As a result, the present invention provides advantages over the prior art.

DETAILED DESCRIPTION OF THE PREFERRED EMBODIMENT

Figure 1:
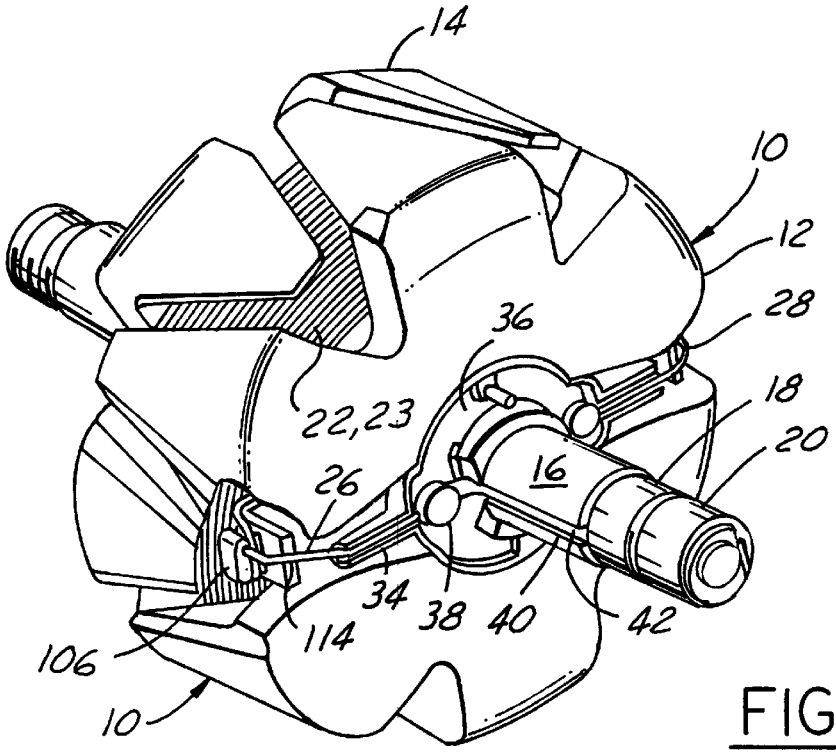
FIG. 1 is a perspective view of a rotor 10 according to one embodiment of the present invention.

Refer first to FIG. 1. A rotor 10 for an electrical machine includes a first pole piece 12 and a second pole piece 14 mounted on a shaft 16 for rotation therewith. Also mounted on shaft 16 for rotation therewith are slip rings 18 and 20. One will recognize rotor 10 as a rotor for an Lundell or "claw pole" alternator.

Mounted within the internal cavity formed by pole pieces 12 and 14 is a field coil 22. Field coil 22 comprises a plurality of turns of electrical wire 23 wound about a plastic bobbin. Wire sections 26 and 28 of electrical wire 23 are routed for electrical connection to slip rings 18 and 20, respectively. Preferably, wire 23 is continuous, with no electrical joints therein except for welded connections directly to slip rings 18 and 20. Details of the connections to slip rings 18 and 20 will be discussed below.

Figure 9:
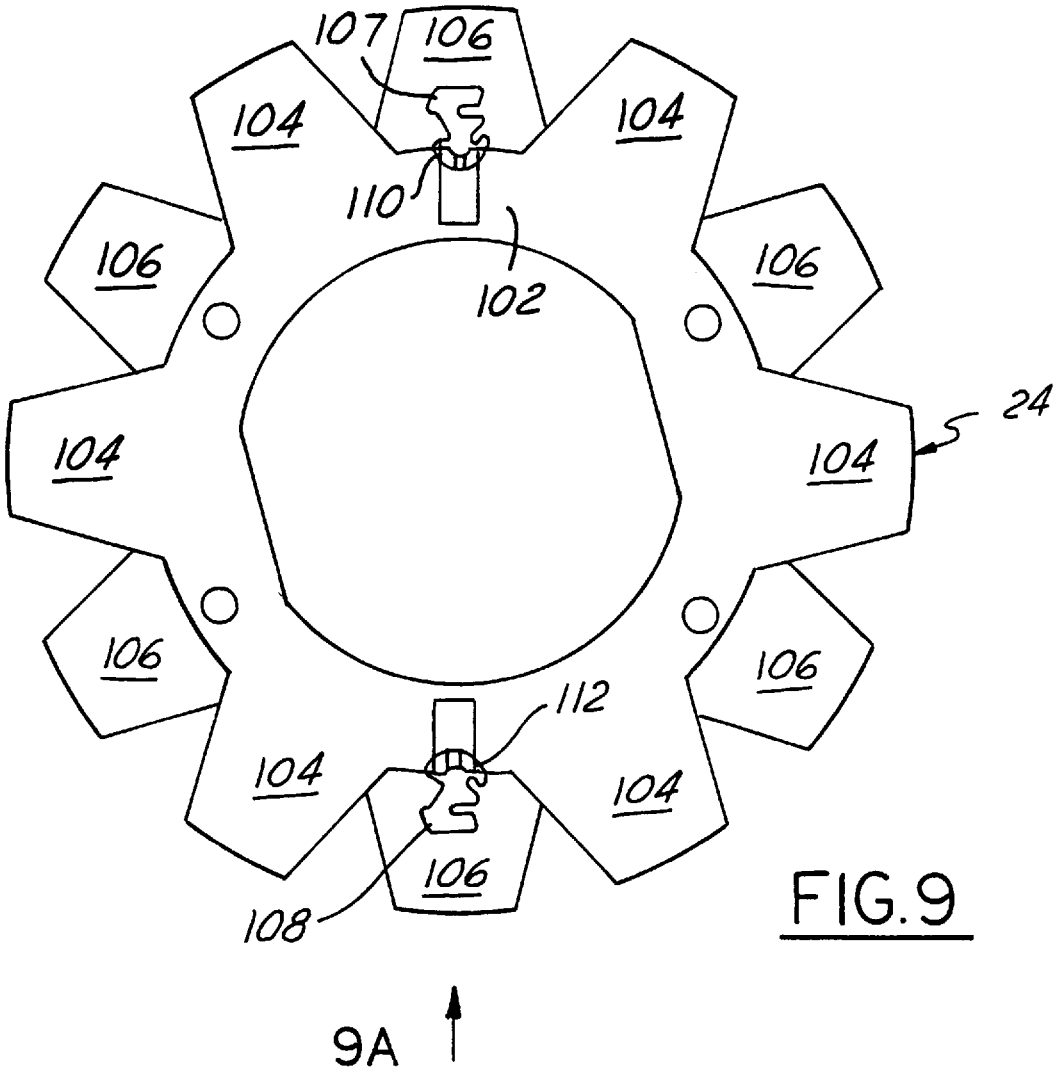
FIG. 9 is a front view of bobbin 24 of rotor 10.
Figure 9A:
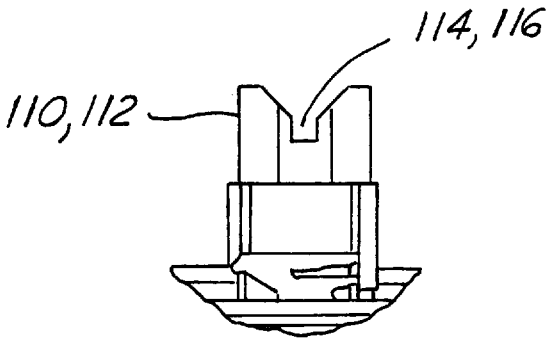
FIG. 9A is a partial view of bobbin 24, taken in the direction of arrow "A" of FIG. 9.

Refer additionally now to FIGS. 9 and 9A for a more detailed description of the bobbin 24 of field coil 22. Bobbin 24 is preferably molded of plastic and includes a generally cylindrical body with two radially-extending end walls. One such end wall is end wall 102, and the second end wall is obscured in FIG. 9 by end wall 102. As is known in the art, a series of flaps 104 extend radially from end wall 102, and a series of flaps 106 extend radially from the second end wall. When bobbin 24 is assembled in rotor 10, flaps 104 and 106 are bent over by the pole fingers of pole pieces 12 and 14, to electrically insulate the wire in field coil 22 from the metallic pole fingers. Extending radially from wall 102 and are "T"-shaped projections 107 and 108. Extending axially from wall 102 are axial projections 110 and 112. Axial projection 110 includes at its end a notch 114 and axial projection 112 includes at its end a notch 116.

Refer now particularly to FIG. 1. Routing of wire sections 26 and 28 to slip rings 18 and 20 is as follows. Wire section 26, after emerging from field coil 22, is wrapped around generally "T"-shaped projection 107 of bobbin 24. Wire section 26 is further located in notch 114. Wire section 26 further is also routed in a channel 34 of a retainer 36. Wire section 26 is also wound around a post 38 of retainer 36 (post 38 being subsequently heat-staked to retain wire section 26) and then routed through an axial groove 40 in shaft 16 for connection to slip ring 18. To prevent electrical short circuits between wire section 26 and shaft 16, an insulating woven sleeve 42 is slipped over wire section 26 where wire section 26 is routed in groove 40.

Wire section 28 is routed to slip ring 20 in an analogous manner to wire section 26.

Figure 3:
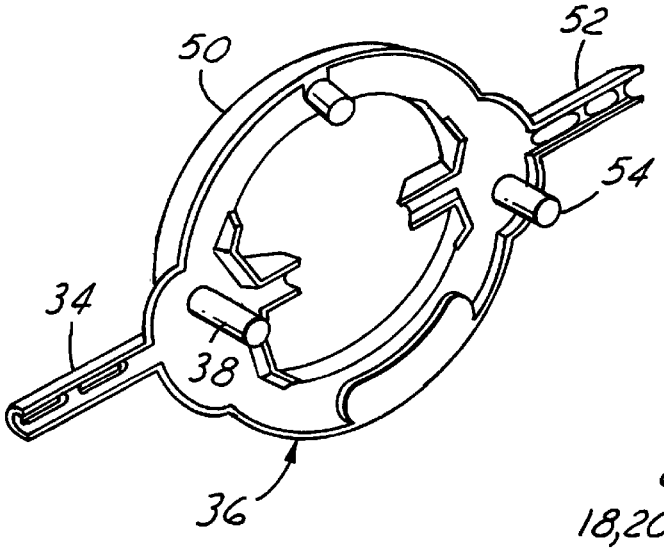
FIG. 3 is a perspective view of retainer 36 of rotor 10.

Retainer 36 will now be described with more particularity, with additional reference to FIG. 3. Retainer 36 includes a generally annular body 50 and radially-extending channels 34 and 52. Also included are posts 38 and 54. Retainer 36 is preferably made of an electrically-insulating material and more preferably of a plastic suitable for heat-staking. As indicated above, wire sections 26 and 28 are wound about posts 38 and 54, respectively. Posts 38 and 54 are then heat staked to help retain wire sections 26 and 28.

Retainer 36 is preferably located in an axially-recessed portion of pole piece 12, such that radially-extending channels 34 and 52 are flush with or below surface 56 of pole piece 12. This facilitates attachment of a stamped fan, if desired, to surface 56. Such a fan may be attached, for example, by projection welding or spot welding.

Figure 4:
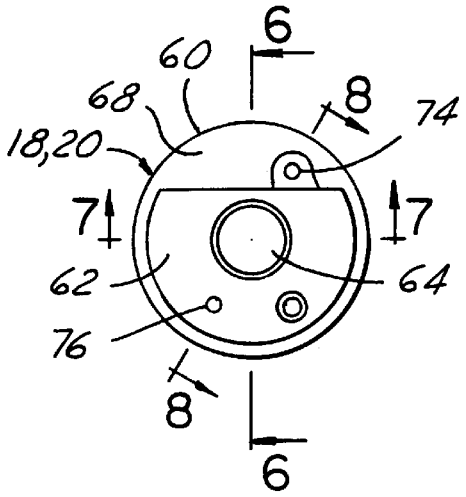
FIG. 4 is an end view of slip rings 18 and 20 of rotor 10.
Figure 6:
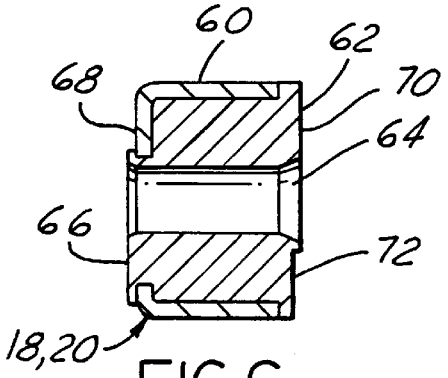
FIGS. 6–8 are cross-sectional views of slip rings 18 and 20 taken along lines 6—6, 7—7 and 8—8, respectively, of FIG. 4.
Figure 5:
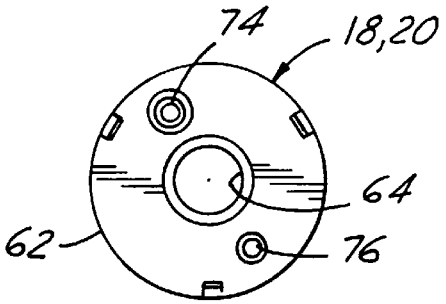
FIG. 5 is an end view of the opposite end of slip rings 18 and 20 of rotor 10.
Figure 7:
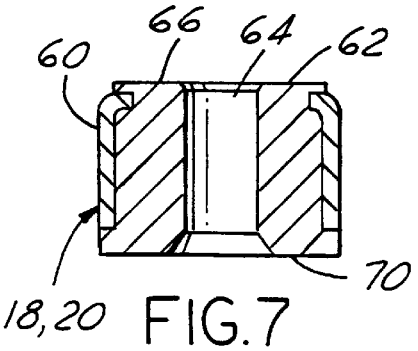
Figure 8:
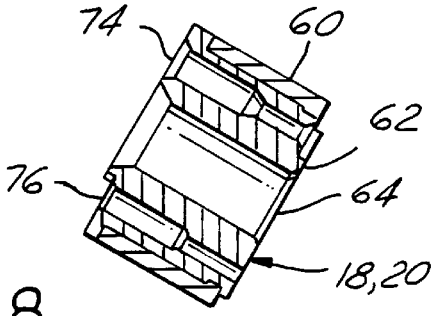

The construction of slip rings 18 and 20 will now be discussed with additional reference to FIGS. 4–8. Slip rings 18 and 20 are preferably identical, to provide economies of scale in their manufacture. Each slip ring includes a copper shell 60 and an injection-molded phenolic plastic body 62. Preferably, all of the copper of copper shell 60 is "integral"; that is, copper shell 60 is preferably formed in one piece, by drawing or by another suitable process. (Note: hereinafter, because slip rings 18 and 20 are preferably identical, features of slip rings 18 and 20 will be labelled with simple reference numerals, except where it becomes necessary to refer to a feature of a particular slip ring 18 or 20. In such an event, an alphabetic suffix will be added to the reference number, as follows: features of slip ring 18 will have an "A" suffix added, and features of slip ring 20 will have a "B" suffix added.) Plastic body 62 defines a bore 64 which accommodates a similarly-sized knurled end portion of shaft 16. As seen in FIG. 4, one end 66 of the slip ring has a pad region 68 which accommodates the welding of the end of the relevant wire section 26 or 28.

Preferably, the ends 66 and 70 of slip rings 18 and 20 are not planar. As can be seen best in FIG. 6, pad region 68 is recessed with respect to the remainder of end 66. Further, surface 72 of end 70 is recessed with respect to the remainder of end 70.

Slip rings 18 and 20 each have two through holes 74 and 76, each hole of diameter slightly larger than wire 23. Hole 74 is located adjacent to pad region 68.

Figure 2:
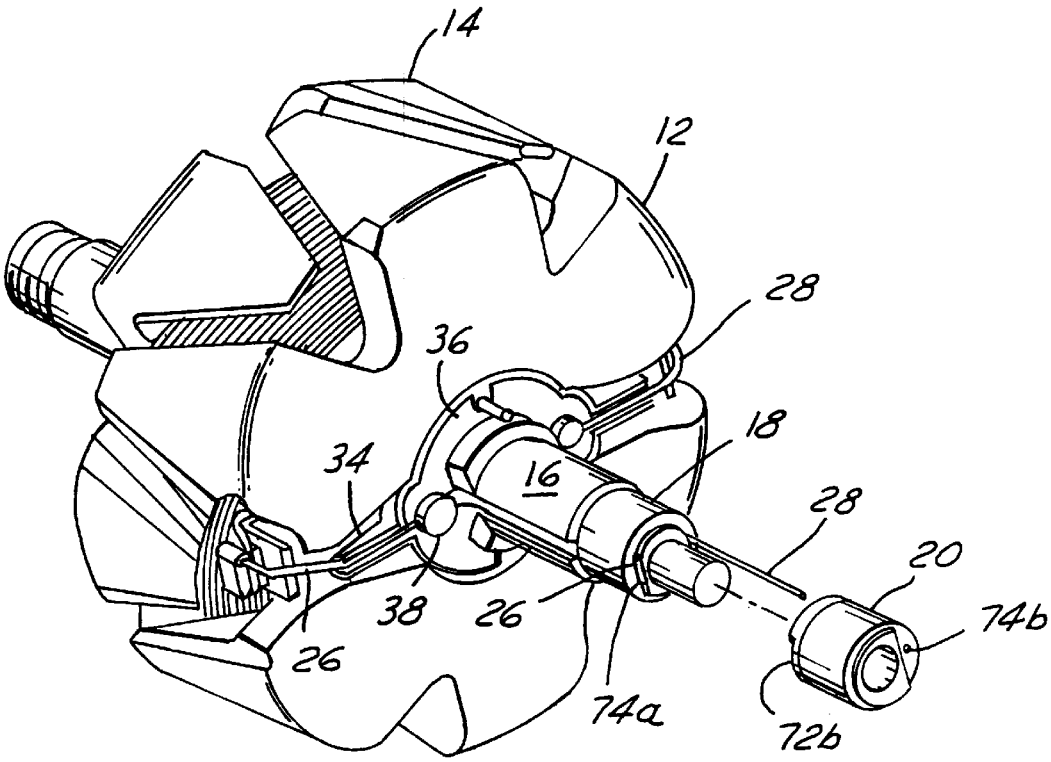
FIG. 2 is a partially-exploded view of rotor 10 of FIG. 1.

With additional reference to FIG. 2, the installation of slip rings 18 and 20 onto shaft 16 and the termination of wire sections 26 and 28 will now be described. Once wire sections 26 and 28 have been routed into their respective axial grooves on shaft 16, slip ring 18 is pressed onto shaft 16 with wire section 26 extending through hole 74A and wire section 28 extending through hole 76A. Wire section 26 is cut to length and ultrasonically welded to pad region 68A of slip ring 18. Wire section 28 extends through hole 76A of slip ring 18 without making electrical connection to slip ring 18.

Slip ring 20 is then pressed onto shaft 16 with wire section 28 extending through hole 74B of slip ring 20. Wire section 28 is then cut to length and welded to pad portion 68B of slip ring 20. One will note that as assembled, slip rings 18 and 20 are rotated 180 degrees with respect to one another about the axis of shaft 16. Pad portion 68A of slip ring 18 and surface 72B of slip ring 20 are thus aligned, allowing space to accommodate the end of wire section 26, which has been welded to pad portion 68A.

One additional feature of slip rings 18 and 20 should be noted. Note from FIGS. 2 and 4–8 that no conductive material of copper shell 60A is in contact with passage 76A. An advantage of such a feature is that there is no concern about inadvertent shorting of wire section 28 with the conductive material of copper shell 60A. As the preceding discussion indicated, wire section 28 passes through passage 76A without making electrical contact with slip ring 18. Were the conductive material of copper shell 60A in contact with passage 76A, an additional insulating sleeve would be required about wire section 28 where this wire section passes through passage 76A.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A rotor for an electrical machine, said rotor comprising:

(a) a shaft defining an axis of rotation of said rotor;

(b) a field-generating coil mounted for rotation with said shaft, said coil comprising wire with a first wire end and a second wire end;

(c) a first slip ring mounted for rotation with said shaft and defining a first circumferential periphery and a first axial end, and comprising first conductive material disposed about said first circumferential periphery and second conductive material disposed on said first axial end, said first conductive material in electrical communication with said second conductive material, said first axial end further having a first portion with respect to which said first conductive material is axially recessed;

(d) a second slip ring mounted for rotation with said shaft and defining a second circumferential periphery and a second axial end, and comprising third conductive material disposed about said second circumferential periphery, said second axial end further having a second and third portion, said second portion axially recessed with respect to said third portion;

wherein said second slip ring is mounted adjacent said first slip ring, with said first axial end and said second axial end adjacent one another and said first conductive material and said second portion aligned to form a gap therebetween; and wherein said first wire end is electrically and physically coupled to said first conductive material.

2. A rotor as recited in claim 1, wherein said first portion abuts against said third portion.

3. A rotor as recited in claim 2, wherein said first slip ring and said second slip ring are identical.

4. A rotor as recited in claim 1, wherein:

said second slip ring further defines a third axial end and further comprises fourth conductive material disposed on said third axial end;

said third conductive material is in electrical communication with said fourth conductive material; and said second wire end is physically and electrically coupled to said fourth conductive material.

5. A rotor as recited in claim 4, wherein:

said third axial end further comprises a fourth portion with respect to which said fourth conductive material is axially recessed.

6. A rotor as recited in claim 5, wherein:

said first slip ring comprises a fourth axial end, said fourth axial end comprising a fifth portion and a sixth portion, said fifth portion axially recessed with respect to said sixth portion.

7. A rotor as recited in claim 6, wherein said first portion abuts against said third portion.

8. A rotor as recited in claim 4, wherein said first slip ring and said second slip ring are identical.

9. A rotor as recited in claim 4, wherein:

said first slip ring defines first and second passages, said first and second passages passing generally axially through said first slip ring;

said second slip ring defines a third passage, said third passage passing generally axially through said second slip ring;

said second and third axial passages are aligned with one another;

said wire passes through said first axial passage with said first wire end emerging for connection with said first conductive material; and said wire passes through said second axial passage and said third axial passage with said second wire end emerging from said third axial passage for connection with said fourth conductive material.

10. A rotor as recited in claim 9, wherein:

said second slip ring has a fourth passage, said fourth passage passing generally axially through said second slip ring;

said fourth passage is aligned with said first passage.

11. A rotor as recited in claim 10, wherein:

said first passage and said second passage are circumferentially disposed 180 degrees apart from one another; and said third passage and said fourth passage are circumferentially disposed 180 degrees apart from one another.

12. A rotor as recited in claim 9, wherein said first slip ring and said second slip ring are identical.

* * * * *